US007234321B2

(12) United States Patent
Maunder et al.

(10) Patent No.: US 7,234,321 B2
(45) Date of Patent: Jun. 26, 2007

(54) METHOD FOR LIQUEFYING METHANE-RICH GAS

(75) Inventors: Anthony D. Maunder, Reading (GB); Geoffrey F. Skinner, Reading (GB)

(73) Assignee: Gasconsult Limited, Berkshire (GB)

( * ) Notice: Subject to any disclaimer, the term of this patent is extended or adjusted under 35 U.S.C. 154(b) by 371 days.

(21) Appl. No.: 10/487,501

(22) PCT Filed: Aug. 20, 2002

(86) PCT No.: PCT/GB02/03844

§ 371 (c)(1),
(2), (4) Date: Aug. 9, 2004

(87) PCT Pub. No.: WO03/019095

PCT Pub. Date: Mar. 6, 2003

(65) Prior Publication Data

US 2004/0255616 A1 Dec. 23, 2004

(30) Foreign Application Priority Data

Aug. 21, 2001 (GB) ..... 0120272.0

(51) Int. Cl.
*F25J 1/00* (2006.01)

(52) U.S. Cl. ..... 62/613; 62/612

(58) Field of Classification Search ..... 62/613, 62/611, 612, 620, 617
See application file for complete search history.

(56) References Cited

U.S. PATENT DOCUMENTS

| | | | | |
|---|---|---|---|---|
| 2,903,858 A | | 9/1959 | Bocquet | 62/11 |
| 3,593,535 A | * | 7/1971 | Gaumer et al. | 62/612 |
| 3,818,714 A | * | 6/1974 | Etzbach et al. | 62/612 |
| 5,651,269 A | | 7/1997 | Prevost et al. | 62/613 |
| 5,950,453 A | * | 9/1999 | Bowen et al. | 62/612 |
| 6,041,620 A | | 3/2000 | Olszewski et al. | 62/612 |
| 6,062,041 A | | 5/2000 | Kikkawa et al. | 62/613 |
| 6,220,053 B1 | * | 4/2001 | Hass et al. | 62/613 |
| 6,289,692 B1 | * | 9/2001 | Houser et al. | 62/613 |
| 6,295,833 B1 | * | 10/2001 | Hoffart et al. | 62/613 |
| 6,449,982 B1 | * | 9/2002 | Fischer | 62/613 |

FOREIGN PATENT DOCUMENTS

| | | |
|---|---|---|
| DE | 198 21 242 A1 | 11/1999 |
| EP | 599 443 A1 | 6/1994 |
| WO | WO 98/59205 A2 | 12/1998 |
| WO | WO 98/59205 A3 | 12/1998 |
| WO | WO 99/31447 A2 | 6/1999 |
| WO | WO 99/31447 A3 | 6/1999 |

OTHER PUBLICATIONS

International Search Report in PCT/GB01/03844 dated Nov. 6, 2002.

* cited by examiner

*Primary Examiner*—William C. Doerrler
(74) *Attorney, Agent, or Firm*—Marshall, Gerstein & Borun LLP

(57) ABSTRACT

A method for liquefying methane-rich gas in the form of a feed gas comprising the steps of cooling the gas and partially liquefying the gas by expansion within an expansion device. The pressure of the gas at the inlet of the expansion device is in the range from 40 bar to 100 bar and pressure of the gas at the outlet of the expansion device is in the range from 2 bar to 10 bar.

21 Claims, 3 Drawing Sheets

METHOD FOR LIQUEFYING METHANE-RICH GAS

This is the U.S. National phase of International Application No. PCT/GB02/03844 filed Aug. 20, 2002, the entire disclosure of which is incorporated herein by reference.

The present invention relates to a method for liquefying methane-rich gas, and more particularly but not exclusively relates to a method for liquefying natural gas.

Natural gas comprises a mixture of light molecular weight hydrocarbon compounds, for example methane, ethane, propane and butane; heavier molecular weight hydrocarbon compounds in reducing proportions; acid gases, for example carbon dioxide and sulphur compounds; water vapor, traces of mercury and other minor constituents. Gases with a large proportion of methane are referred to as methane-rich gases.

Current commercial production of liquefied natural gas is carried out by a series of process steps which comprise:

removing from a gas feed carbon dioxide and sulphur compounds by washing with a suitable solvent, for example an amine, and if appropriate removing traces of mercury;

drying the gas with molecular sieves;

cooling the gas to around −30 degrees Celsius to condense and remove from the feed gas natural gas liquids containing propane, butane and heavier hydrocarbons in order that the butane and heavier hydrocarbon component content of a final product does not exceed generally accepted limits; and further cooling and liquefaction to produce liquefied natural gas.

Conventional base load plants liquefy large amounts of natural gas at the point of production, for example as preparation for ocean transport. The liquefaction is achieved by cooling the gas in a heat exchanger device, most often at pressure. The liquid that is produced is reduced to near atmospheric pressure at the conclusion of the process.

Currently the main process options for base load plants for the cooling and liquefaction stages described hereinabove are the "Cascade" process, the "Mixed Refrigerant" process and a combination of the two.

The "Cascade" process involves the cooling of natural gas in a series of heat exchanger devices at successively lower temperatures using a series of pure refrigerants. After removal of carbon dioxide, sulphur compounds, mercury and water vapor, initial cooling of the feed gas to about −30 degrees Celsius is usually performed by a propane refrigeration cycle. Natural gas liquids are usually separated at this temperature level and sent away for fractionation. Usually, secondary cooling by an ethylene cycle then reduces the temperature of the feed gas to about −100 degrees Celsius. Liquefaction is carried out by a methane refrigeration cycle. The "Cascade" process is efficient in energy but tends to be complex in the refrigeration system. The requirement to supply ethylene, which is not normally available, is also a disadvantage.

The "Mixed Refrigerant" process uses a mixed refrigerant that evaporates over a considerable temperature range in place of the series of separate refrigerants used in the "Cascade" process. The composition of the mixed refrigerant is optimised such that its evaporation curve corresponds to the condensing curve of the natural gas. This process, although relatively simple, has a power consumption that is greater than the "Cascade" process.

In order to reduce power consumption, the "Cascade" and "Mixed Refrigerant" processes can be combined. Most commonly there is a three level propane refrigeration unit with evaporation temperatures of about 15 degrees, −7 degrees, and −30 degrees Celsius. After removal of carbon dioxide, sulphur compounds, mercury and water vapor, the natural gas is cooled by evaporation of propane through these successive stages and natural gas liquids are separated as described hereinabove. The natural gas then passes to a main cryogenic heat exchanger where it is liquefied at pressure by heat exchange with circulating mixed refrigerants followed by a final flash to atmospheric pressure. The propane refrigeration process described hereinabove is also used to cool the circulating mixed refrigerants in successive stages to approximately −30 degrees Celsius. This process, although designed to maximise thermodynamic efficiency, is relatively complex.

The current processes described above require the import or the preparation, distillation and/or storage of significant volumes of closed-circuit refrigerants that are either pure substances or are mixtures requiring close control of composition.

Natural gas and methane-rich gases derived from oil wells are generally produced from the wells at elevated pressure, typically up to 100 bar. In contrast, liquefied natural gas is generally stored at atmospheric pressure. It would therefore be advantageous to use this pressure differential to generate refrigeration in order to cool the gas and liquefy it.

In general, liquefaction of feed gas takes place in a heat exchanger. However, liquefaction may also take place in an expansion engine device, for example a turbine liquefying expander.

U.S. Pat. Nos. 2,903,858 and 5,651,269 describe liquefaction of natural gases within liquefying expander devices. U.S. Pat. No. 5,651,269 describes production of liquefied natural gas within an liquefying expander having its inlet pressure in a defined supercritical, dense phase and its outlet at virtually atmospheric pressure.

The expression "dense phase" as defined therein and as used herein denotes a condition of the expander feed with both (1) pressure equal to or higher than the critical pressure and (2) specific entropy equal to or lower than its specific entropy at its critical pressure and temperature.

It is not at all clear from U.S. Pat. No. 5,651,269 that operation with expander inlet conditions within the above-defined "dense phase" confers any distinct economic benefit relative to operation with expander pressure above the critical pressure, but outside the "dense phase" (i.e., with specific entropy higher than the entropy at the critical pressure and temperature). Moreover, the use of virtually atmospheric pressure at the expander outlet in accordance with the patent does not confer any discernible benefit, particularly when the adverse influence of increasing expander pressure ratio on the efficiency of practicable expanders is taken into consideration.

There is a need, therefore, for a method of liquefying methane-rich gas, for example natural gas, which is relatively less complex and more economic than current methods, particularly at lower plant capacities. There is also a need for a method of reducing or removing the need to import, distill and store quantities of refrigerant.

It is the object of the invention to provide a method of liquefying methane-rich gas which overcomes or eliminates these problems.

According to the present invention there is provided a method for liquefying methane-rich gas in the form of a feed gas comprising at least the steps of cooling the gas and partially liquefying the gas by expansion within an expansion device, such that the pressure of the gas at the inlet of the expansion device is in the range from 40 to 100 bar and the pressure of the gas at the outlet of the expansion device is in the range from 2 to 10 bar.

The pressure of the gas at the outlet of the expansion device may be in the range from 3 to 7 bar. The pressure of the gas at the outlet of the expansion device may be in the range from 4 to 6 bar, and preferably be substantially 5 bar.

The pressure of the gas at the inlet of the expansion device may be in the range from 40 bar up to a pressure below the critical pressure of the gas, and preferably in the range from 45 bar up to a pressure below the critical pressure of the gas.

The methane-rich gas may be cooled in at least one heat exchange device and the at least one heat exchange device may utilise additional refrigeration means.

The additional refrigeration means may comprise a substantially closed circuit refrigeration system of cycling refrigerant material.

The method may include an additional step of removing a by-product material and processing the by-product material to produce refrigerant material to fill and/or compensate for losses of material from the substantially closed circuit refrigeration system.

The by-product material may be obtained by separation of material from a flash gas.

The by-product material may be obtained from processing of the feed gas.

The by-product material may comprise compounds selected from propane, butane and heavier hydrocarbon compounds.

The by-product material may be flashed within a flash vessel to produce a refrigerant vapor.

The by-product material entering the flash vessel may have a pressure in a range from 20 bar to 1 bar, and preferably in the range from 10 bar to 5 bar.

The by-product material entering the flash vessel may be at a temperature in a range from −20 degrees Celsius to 60 degrees Celsius, and preferably in a range from 20 degrees Celsius to 40 degrees Celsius.

The vapor may be incorporated into the refrigerant material of the substantially closed circuit refrigeration system.

The methane-rich gas may be cooled to a temperature in a range from −50 degrees Celsius to 5 degrees Celsius below its dew point, and preferably to a temperature substantially equivalent to its dew point, prior to entry into the expansion device.

The methane-rich gas may be outside a phase equivalent to its dense phase prior to entry into the expansion device.

For a better understanding of the present invention and to show more clearly how it may be carried into effect reference will now be made, by way of example, to the accompanying drawings in which.

The invention particularly relates to a method of liquefaction wherein a feed of methane-rich gas is cooled in at least one heat exchanger to between −50 degrees Celsius and 5 degrees Celsius below its dew point, nominally −82.5 degrees Celsius at a pressure of 40 to 100 bar, and is then partially liquefied by expansion within an expansion device, for example a liquefying expander, producing mechanical work. The inlet pressure to the expander is in the range from 40 bar to 100 bar, for example 40 bar up to a pressure below the critical pressure, and preferably in the range from 45 bar up to a pressure below the critical pressure.

A liquefying expander is a device, such as a turbine, for converting the energy of a gas stream into mechanical work as the gas expands through the expander. The expansion process occurs rapidly, and heat transferred to or from the gas is usually very small. When a flow of gas is reduced from a high pressure to some lower pressure the energy produced can be recovered to do mechanical work. This extraction of energy as mechanical work provides more cooling than a simple expansion device, such as a valve.

The expansion of the methane-rich gas within the liquefying expander produces a liquid fraction and a vapor stream which may be separated from each other. The liquid fraction may form the primary product of the liquefaction process. The vapor stream may be reheated to near-ambient temperature in a second passage through the at least one heat exchanger, counter-current to the feed to the liquefying expander.

Figure 1:
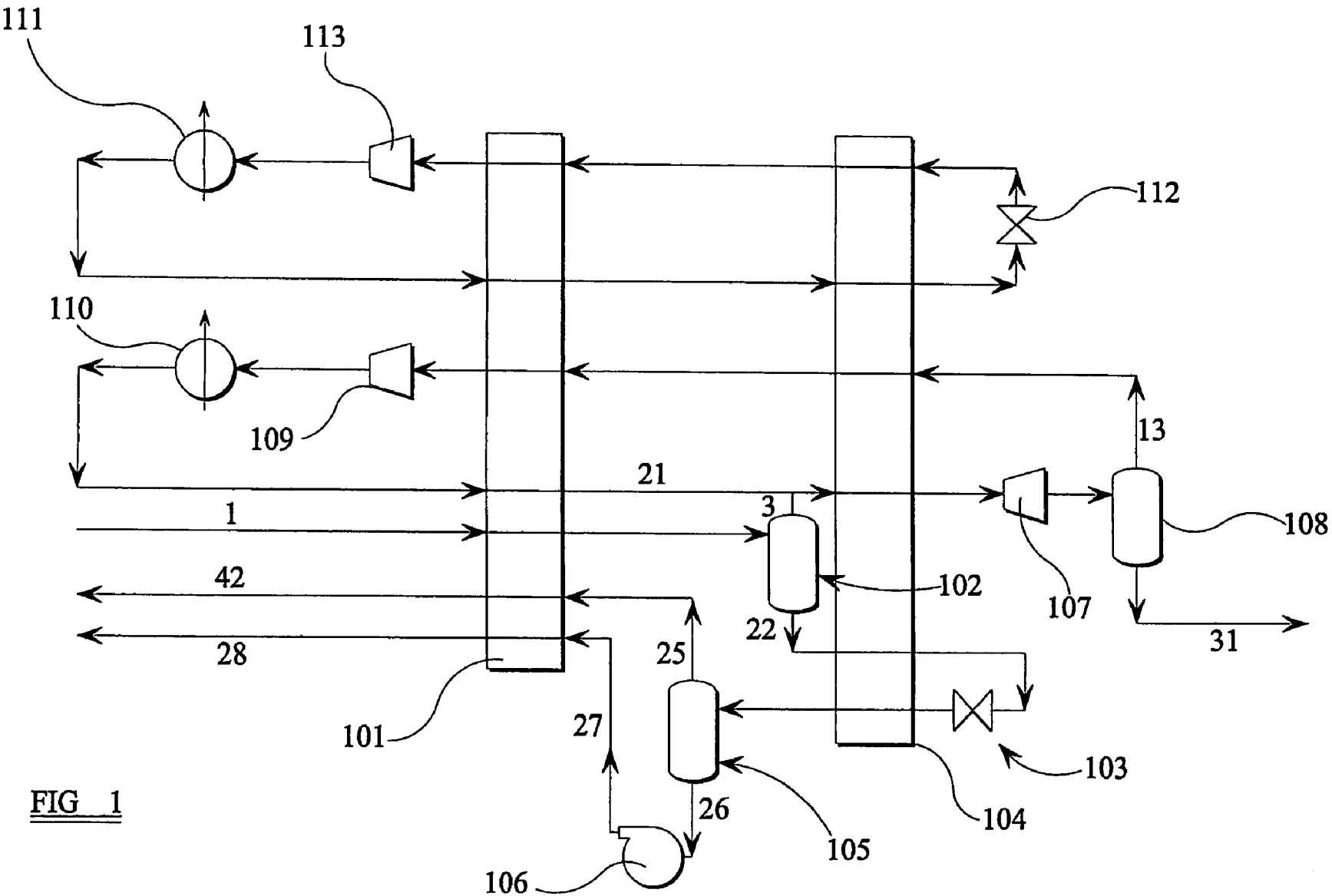
FIG. 1 shows a schematic representation of the processes of a first embodiment of a method for liquefying methane-rich gas according to the present invention.

In the first embodiment of the present invention, as illustrated in FIG. 1, a stream 1 of incoming feed gas, for example natural gas, has been treated to remove components, for example carbon dioxide, hydrogen sulphide and water vapor, which would interfere with the liquefaction process, for example by freezing. The feed gas enters the system at a pressure almost equivalent to, but lower than, its critical pressure and at substantially ambient temperature. The feed gas initially enters a precooler 101 in which it is cooled to a temperature between −20 degrees and −40 degrees Celsius and forms a cooled process stream. After exiting the precooler 101, the cooled process stream enters a condensate separator 102 within which the process stream is separated into a vapor stream 3 and a liquid condensate stream 22. The liquid condensate stream 22 consists mainly of propane, butane and heavier hydrocarbons. The purpose of the separation is to remove $C_4$ and $C_5$+ hydrocarbons as natural gas liquids in order that the concentrations of these components in the final liquefied natural gas produced by the method do not exceed commonly accepted maximum levels.

The condensate liquid stream 22 leaving the condensate separator 102 is treated to reduce its vapor pressure to a value acceptable for storage and transport. The condensate liquid stream 22 is initially flashed through a pressure reduction valve 103 to produce a stream with a pressure in a range from 3 to 6 bar and with a temperature in the range from −80 degrees to −70 degrees Celsius. The resulting stream from the reduction valve 103 is then heated in a heat exchanger 104 to a temperature in a range from −30 degrees to −50 degrees Celsius. The heated stream from the heat exchanger 104 enters a condensate flash vessel 105, within which the heated stream is separated into a vapor stream 25, containing most of the methane content, and a liquid stream 26 substantially free from methane. The liquid stream 26 flows to a natural gas liquid pump 106. The vapor stream is passed back to the precooler 101 where it is heated to near-ambient temperature prior to being removed from the system as a stream 42 of flash gas. The outlet stream 27 from the natural gas liquid pump 106 is also passed back into the precooler 101 where it is heated to near ambient before being removed from the system as a stream 28 of by-product material. The discharge pressure of the natural gas liquid pump 106 is sufficient to ensure that this natural gas liquid by-product is entirely in the liquid phase at ambient temperature.

The vapor stream from the condensate separator 102 is mixed with a stream 21 of recycle gas which typically contains over 95 molar percent methane. The formation of the recycle gas will be described herein below. This mixture of vapor stream and recycle gas is passed through the heat exchanger 104 within which the mixture is cooled to a temperature in a range from −50 degrees Celsius to around the dew point. The mixture then passes into an expansion engine in the form of a liquefying expander 107. The mixture entering the liquefying expander 107 is preferably at a temperature substantially equivalent to its dew point, and at a pressure in the range from 40 bar up to a pressure marginally below the critical pressure, and preferably in the range from 45 bar up to a pressure marginally below the critical pressure, and as such not in its dense phase. The mixture on exiting the liquefying expander 107 has an outlet pressure in the range from 2 bar to 10 bar, for example in the range from 3 bar to 7 bar, preferably in the range from 4 bar to 6 bar, and more preferably substantially 5 bar. The mixture exiting the liquefying expander 107 flows into a product separator 108 in which the mixture is separated into a liquid fraction and a vapor stream 13. The liquid fraction is removed as a stream 31 of primary liquefied natural gas product from the system. The vapor stream 13 from the product separator 108 is reheated in the heat exchanger 104 and precooler 101. The vapor stream is then compressed by a compressor 109 and cooled by heat exchange with external coolants in a cooler 110. The vapor stream is further cooled in the precooler 101 to form the abovementioned recycle gas.

As the opposing flows through the precooler 101 and heat exchanger 104 are inherently unequal, as the vapor stream has lower flow and therefore lower heat capacity relative to the feed to the liquefying expander, it follows that it is impossible, without a supplementary source of refrigeration, to maintain a close temperature difference throughout the heat exchanger and precooler. This additional refrigeration may be provided by evaporation of a separate stream of a hydrocarbon refrigerant. In this embodiment, the refrigerant is provided by an essentially closed circuit refrigerant system comprising a condenser 111, a flash valve 112 and a compressor 113. The fluid basis of the refrigerant comprises a mixture of ethane, propane, butane, pentane plus some methane.

In the method described for the first embodiment of the present invention, and shown schematically in FIG. 1, the provision of make-up fluid of a suitable composition for the closed circuit refrigeration system can be relatively inconvenient and expensive, particularly in inaccessible and offshore or marine locations.

Figure 2:
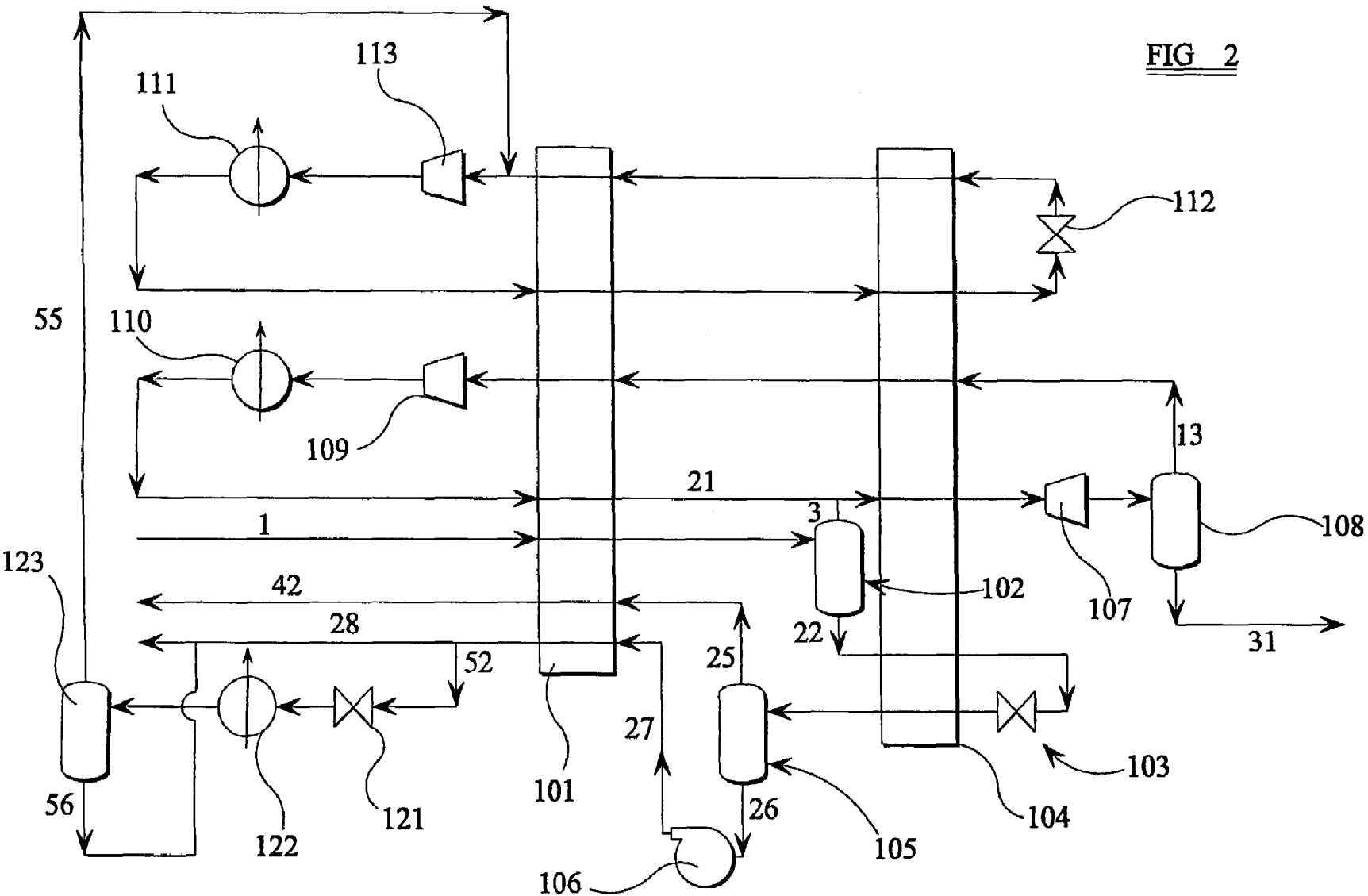
FIG. 2 shows a schematic representation of the processes of a second embodiment of a method for liquefying methane-rich gas according to the present invention.

In a second embodiment of the present invention, as shown in FIG. 2, a means of preparing refrigerant mixtures of suitable composition for the provision of make-up fluid for the closed circuit refrigeration system is incorporated into the method of liquefying a methane-rich gas.

FIG. 2 is identical to FIG. 1 except for the presence of the refrigerant preparation equipment. In the second embodiment of the present invention, the processes described for the processing of the feed gas to remove the natural gas liquid and flash gas products, and to produce the liquefied natural gas product, are identical to those described for the first embodiment.

To produce the make-up refrigerant fluid, a portion of the natural gas liquid by-product stream is removed, for example on an intermittent basis, and the liquid by-product stream 52 flows to a pressure reduction valve 121. The outlet stream from the valve 121 enters a natural gas liquid heater 122 where the liquid by-product is heated before flowing into a natural gas liquid flash vessel 123. The liquid by-product has a pressure in the range from 20 bar to 1 bar, and preferably a pressure in the range from 10 bar to 5 bar on entering the flash vessel 123. The liquid by-product is at a temperature in the range from −20 degrees to 60 degrees Celsius, and preferably in the range from 20 degrees to 40 degrees Celsius entering the flash vessel 123. Within the flash vessel 123, the liquid by-product is flashed to produce a vapor stream. Any remaining liquid phase material is returned via stream 56 to the natural gas liquid by-product stream 28 which exits the system. The vapor stream 55 from the flash vessel 123 is admitted, when required, into the suction of the compressor 113 in order to maintain the inventory of refrigerant in the hereinabove mentioned closed circuit refrigeration system.

In order to make up and maintain a suitable refrigerant composition from a wide range of composition of the feed gas, the outlet pressure from pressure reduction valve 121 and outlet temperature from the natural gas liquid heater 122 are regulated so that the liquid by-product entering the natural gas liquid flash vessel 123 has a pressure under 20 bar, preferably in a range from 5 to 10 bar, and a temperature in a range from −20 degrees to 60 degrees Celsius, and preferably in a range from 20 degrees and 40 degrees Celsius.

If it is necessary to change the composition in the closed circuit refrigeration system, for example in order to allow for change in conditions, refrigerant may be also removed from the refrigeration system, for example after the condenser 111. This will cause new vapor material from the natural gas liquid flash vessel 123 to be admitted to the refrigeration system.

Figure 3:
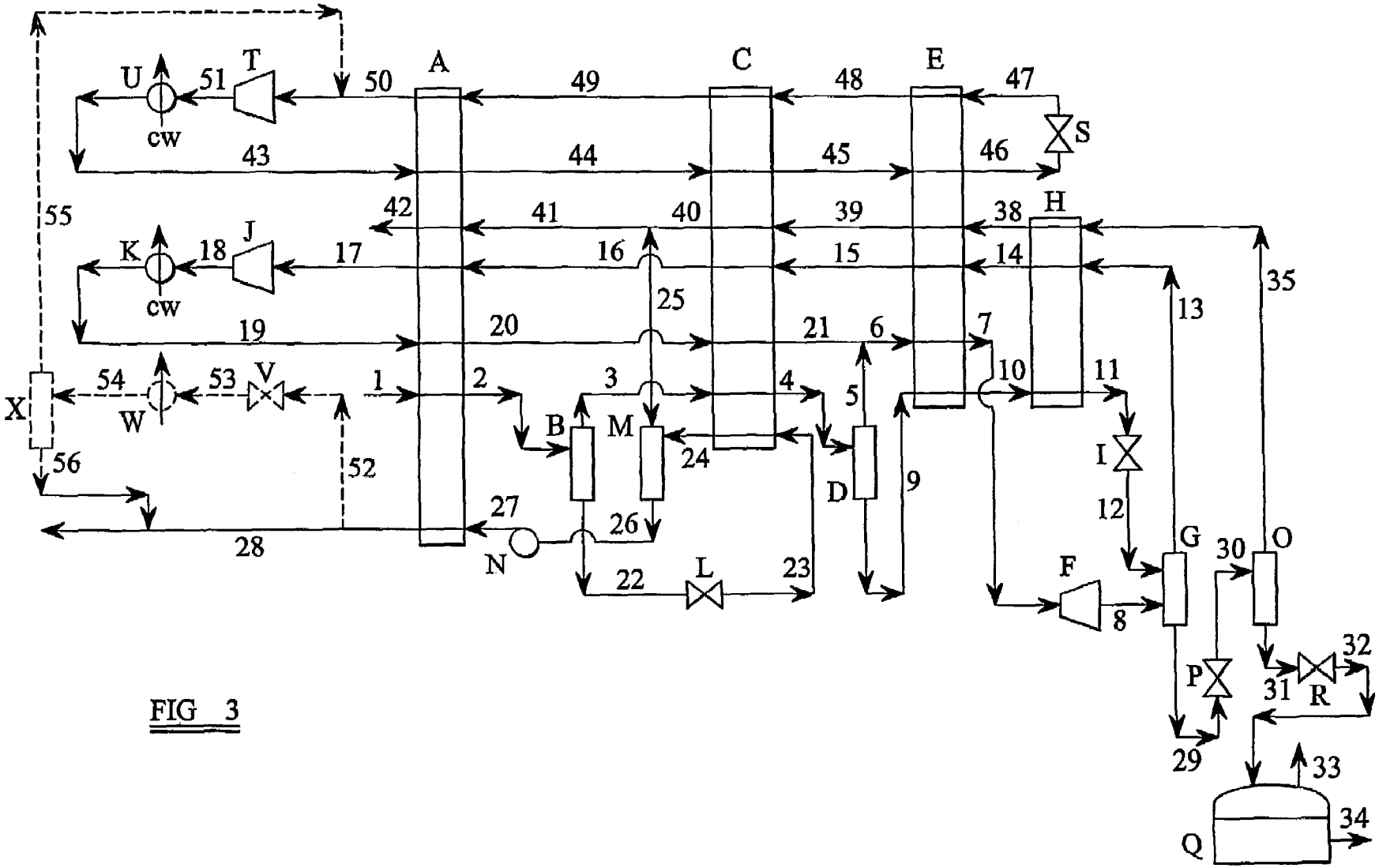
FIG. 3 shows a schematic representation of the processes of a third embodiment of a method for liquefying methane-rich gas according to the present invention.

A third embodiment of the present invention is shown in FIG. 3.

A feed gas 1 containing more than 50 molar percent methane, after removal of any components which would interfere with downstream liquefaction processes, enters the system at a pressure in a range from 40 bar to the critical pressure of the gas, and substantially at ambient temperature.

The feed gas 1 is cooled to a temperature in a range from −20 degrees to −60 degrees Celsius, preferably in a range from −25 degrees to −40 degrees Celsius, in a first heat exchanger A. The cooled process stream 2 enters a first separator B, within which the stream 2 is separated into a vapor stream 3 and a condensate liquid stream 22 comprising propane, butane and heavier hydrocarbons with some methane. The main purpose of this separation is to reduce the butane and heavier hydrocarbon content of the vapor stream 3 in order that concentrations do not exceed commonly accepted maximum values. Another purpose of the separation in the separator B is to provide a source of refrigerant fluid for an integral refrigeration system as described hereinafter.

Stream 3 is cooled to a temperature in a range from −40 degrees to −90 degrees Celsius, and preferably in a range from −60 degrees to −80 degrees Celsius, in a second exchanger C. The cooled process stream 4 enters a second separator D, from which leaves a vapor stream 5 and a liquid stream 9 of condensate comprising mainly methane, ethane, propane, butane and pentane.

Vapor stream 5 is mixed with a stream of recycle gas 21. The recycle stream gas contains typically over 95 molar percent methane at a temperature in a range from −40 degrees to −90 degrees Celsius, and preferably in a range from −60 degrees to −80 degrees Celsius. The mixture of stream 5 and stream 21 produces stream 6, which is then cooled in a third heat exchanger E to within 5 degrees Celsius of its dew point temperature, which will typically lie in a range from −75 degrees to −85 degrees Celsius, and preferably is cooled to substantially its dew point. The cooled stream 7 flows to a liquefying expander F entering at a pressure in the range from 40 bar up to a pressure marginally below the critical pressure, and preferably in the range from 45 bar up to a pressure marginally below the critical pressure and as such not in its dense phase, and emerging as stream 8 with a pressure in a range from 2 to 10 bar, for example in a range from 3 to 7 bar, preferably in a range from 4 to 6 bar, most preferably at substantially 5 bar, and with a liquid fraction in a range from 20 to 40 molar percent. Stream 8 flows to a third separator G.

Liquid stream 9, as hereinabove mentioned, is cooled in the third heat exchanger E emerging as stream 10, and is then further cooled in a fourth heat exchanger H emerging as stream 11 having a temperature in a range from −110 degrees and −150 degrees Celsius, preferably in a range between −120 degrees and −140 degrees Celsius, and with its hydrocarbon content substantially condensed to a sub-cooled liquid. Stream 11 is then depressurised through a first pressure reduction valve I and enters a third separator G.

The third separator G has an outlet vapor stream 13 and an outlet liquid stream 29, both comprising mainly methane. Stream 13 is reheated to near-ambient temperature by passing successively through the fourth heat exchanger H emerging as stream 14, the third heat exchanger E emerging as stream 15, the second heat exchanger C emerging as stream 16 and the first heat exchanger A emerging as stream 17.

Stream 17 is compressed in a compressor J such that the pressure of outlet stream 18 is approximately equivalent to the pressure of the incoming feed gas stream 1.

Stream 18 is cooled by air or water in a first cooler K to near-ambient temperature, for example in a range from 20 degrees to 45 degrees Celsius. The cooled stream 19 is next cooled by passing it successively through the first heat exchanger A emerging as stream 20 and the second heat exchanger C emerging as stream 21, whereupon stream 21 joins stream 5 as described hereinabove.

As described hereinabove, a condensate liquid stream 22 is produced early in the system in the first separator B. The condensate stream 22 is flashed through a second pressure reduction valve L to a pressure under 10 bar, and preferably in a range from 3 to 6 bar. The resulting stream 23 is heated in the second heat exchanger C to a temperature in a range from −20 degrees to −60 degrees Celsius, and preferably in a range from −30 degrees to −50 degrees Celsius. The heated stream 24 enters a fourth separator M, from which exits a vapor stream 25, containing most of the methane content of stream 24, and a liquid stream 26 which is substantially free from methane. Liquid stream 26 flows into a natural gas liquid pump N. The outlet stream 27 from the natural gas liquid pump N is heated in the first heat exchanger A to near-ambient temperature, for example in a range from 20 degrees to 45 degrees Celsius. The heated stream 28 is a natural gas liquid by-product of the process. The discharge pressure of the natural gas liquid pump N is sufficient to ensure that stream 28 is entirely in the liquid phase.

Liquid stream 29 from the third separator G enters a third pressure reduction valve P and is flashed to a lower pressure and temperature to form stream 30 which is then passed into a fifth separator O. The outlet liquid, stream 31, from the fifth separator O has a temperature in a range from −155 degrees to −161 degrees Celsius and constitutes the liquefied natural gas product from the process. Stream 31 is flashed through a fourth pressure reduction valve R to substantially atmospheric pressure and it then enters a liquefied natural gas storage tank Q as stream 32. A small flow, stream 33, of vent gas from the storage tank Q occurs, and the final liquefied natural gas product is removed from the tank as stream 34.

The gas outlet stream 35 from the fifth separator O is at a pressure in a range up to 3 bar, and preferably up to 1.5 bar. Stream 35 is heated successively in the fourth heat exchanger H emerging as stream 38, the third heat exchanger E emerging as stream 39 and the second heat exchanger C emerging as stream 40 at a temperature in a range from −20 degrees to −60 degrees Celsius, and preferably in a range from −25 degrees to −40 degrees Celsius. Stream 40 is joined by the aforementioned stream 25, from the fourth separator M, to form a combined stream 41. Stream 41 flows to the first heat exchanger A. The heated outlet stream 42 from the first heat exchanger A has a pressure under 2 bar and a near-ambient temperature, for example in a range from 20 degrees to 45 degrees Celsius. Stream 42 is designated a fuel gas and it is discharged to flare, is vented or is discharged to a suitable combustion device (not shown).

Additional refrigeration down to a temperature substantially −100 degrees Celsius is provided by a closed circuit refrigerant system, which has as a working fluid a mixture comprising ethane, propane, butane, pentane and some methane. Stream 43 is mainly liquid at near-ambient temperature, for example in a range from 20 degrees to 45 degrees Celsius. Stream 43 is cooled successively in the first heat exchanger A emerging as stream 44, in the second heat exchanger C emerging as stream 45 and finally in the third heat exchanger E emerging as stream 46 at a temperature in a range from −50 degrees to −120 degrees Celsius, and preferably in a range from −70 degrees to −100 degrees Celsius.

Stream 46 is flashed through a fifth pressure reduction valve S, emerging as stream 47 at a pressure less than 3 bar, and preferably less than 1.5 bar. Stream 47 is then reheated successively in the third heat exchanger E emerging as stream 48, the second heat exchanger C emerging as stream 49 and finally in the first heat exchanger A emerging as stream 50 at a temperature in a range from 0 degrees to 30 degrees Celsius. Stream 50 is compressed in a second compressor T to give outlet stream 51, which is cooled and condensed by air or water in a second cooler U, emerging as stream 43 as mentioned hereinabove. The discharge pressure of the second compressor T is near to or in excess of the saturation pressure of stream 43.

Refrigerant fluid required to fill and/or compensate for losses from the abovementioned closed circuit refrigerant system comprising streams 43 to 51 is obtained by processing a portion of the natural gas liquid by-product stream 28. Stream 52 is removed from stream 28, for example on an intermittent basis, and flows to a sixth pressure reduction valve V. The outlet stream 53 from this valve V enters a fifth heat exchanger W, which has an outlet stream 54. The outlet pressure from sixth pressure reduction valve V and outlet temperature from the fifth heat exchanger W are regulated such that stream 54 has a pressure in the range from 1 bar to 20 bar, preferably in a range from 5 to 10 bar, and a temperature in a range from −20 degrees to 60 degrees Celsius, preferably in a range from 20 degrees to 40 degrees Celsius. Stream 54 enters a sixth separator X, from which leaves a vapor stream 55 and a liquid stream 56. The vapor stream 55 is admitted, when required, to stream 50, for example via an appropriate intermediate suction stage of the second compressor T, in order to maintain the inventory of refrigerant in the closed circuit refrigeration system.

If it is desired to change the composition of the refrigerant in the closed circuit refrigeration system, for example in response to a change in conditions in the process as a result of external events, liquid may be removed from the outlet of the second cooler U and the volume of refrigerant will be compensated by an increase in stream 55.

For all three embodiments of the present invention described hereinabove it was unexpectedly found that the optimum conditions for the operation of the liquefying expander 107, F are an inlet temperature in the range from −50 degrees Celsius to 5 degrees Celsius below the dew point temperature of the feed stream to the liquefying expander, and preferably a temperature substantially equivalent to the dew point, and simultaneously a pressure which is in a range from 40 bar to below the critical pressure of the feed stream, which is generally in a range from 45 to 50 bar, and preferably in a range from 45 bar to below the critical pressure of the stream, and an outlet pressure in a range 2 to 10 bar, for example in a range from 3 to 7 bar, preferably in a range from 4 to 6 bar, and most preferably at substantially 5 bar.

The fractional liquefaction of the feed gas within the liquefying expander declines significantly as the inlet pressure is reduced from the critical pressure towards 40 bar, with a resulting adverse effect on the overall cycle efficiency. Table 1 below shows how the relative power of the system is related to the pressure at the liquefying expander inlet for a constant outlet pressure.

TABLE 1

| Liquefying Expander Inlet Pressure (bar) | Relative Power |
|---|---|
| 47 | 100 |
| 45 | 103 |
| 40 | 110 |
| 30 | 150 |

The fractional liquefaction of the feed gas within the liquefying expander declines significantly as the inlet temperature of the feed gas is increased above its dew point temperature, with a resulting adverse effect on the overall cycle efficiency. In general terms it appears that if the inlet temperature is 1.0 degrees Celsius above the dew point, the net power consumption of a system is increased by around 5 percent. It is not advantageous to cool the methane-rich gas to below the dew point as there is a discontinuity in the cooling curve of methane as it passes through the dew point. In order to avoid a temperature cross occurring in the heat exchanger situated before the liquefying expander the temperature differences in the majority of the heat expander have to be widened.

This is less thermodynamically efficient and represents lost work. However, under actual working conditions it is possible that occasionally the methane-rich gas may be cooled to below the dew point but this is not intentional.

The feed to the liquefying expander should contain the minimum proportions possible of hydrocarbons heavier than methane and the maximum proportion possible of methane. This is because the larger the proportion of liquid in the liquefying expander outlet, the lesser amount of gas that is required to be compressed and recycled. The presence of hydrocarbons heavier than methane in the liquefying expander feed raises the dew point temperature and hence raises the lowest temperature which is possible for the feed gas to the liquefying expander because most expansion engines will not operate with any liquid content in the liquefying expander inlet stream. Hence the presence of hydrocarbons heavier than methane reduces the maximum possible liquid fraction in the liquefying expander outlet.

For a given assumed adiabatic efficiency of the liquefying expander and given means of cooling the liquefying expander product liquid to the bubble point temperature of methane at atmospheric pressure, substantially −161 degrees Celsius, the best overall thermal efficiency is obtained with the liquefying expander outlet pressure at substantially 5 bar.

The total power of the system is calculated by measuring the power for the recycle compressor minus a liquefying expander, plus the power for re-compression of flashed gas from atmospheric pressure to the liquefying expander outlet pressure. Table 2 below shows how the total power for liquefaction is at a minimum at an expander outlet pressure around 5 bar. Table 2 was calculated for a constant inlet pressure of 47 bar, but the existence of a minimum total power requirement at close to 5 bar expander outlet pressure has been confirmed over an expander inlet pressure range from 40 bar to 70 bar. This minimum power requirement at around 5 bar expander outlet pressure is unexpected, as minimum power requirement would generally be expected to be associated with minimum expander outlet pressure (i.e., substantially atmospheric pressure) and hence maximum cooling effect. Moreover, U.S. Pat. No. 5,651,269 teaches that expander outlet pressure should be virtually atmospheric.

TABLE 2

| Liquefying Expander Outlet Pressure (bar) | Relative Power |
|---|---|
| 1.4 | 151 |
| 1.5 | 144 |
| 2.0 | 128 |
| 4.1 | 105 |
| 4.5 | 103 |
| 5.1 | 100 |
| 5.5 | 102 |
| 6.1 | 105 |
| 10.0 | 118 |

The adiabatic efficiency of practicable liquefying expander turbines in this type of system deteriorate significantly when the liquefying expander pressure ratio exceeds approximately 10.

Although the embodiments refer to natural gas it is appreciated that the feed gas could be any methane-rich gas, for example associated gas-which is a methane-rich gas that is produced in combination with the extraction of liquid petroleum hydrocarbons. It should also be appreciated that where compressors are referred to, they may consist of several separate compressors with coolers in between them, or a compressor with an incorporated cooler.

Throughout this document pressures given in bar should be taken to mean bar absolute.

The invention claimed is:

1. A method for liquefying methane-rich gas in the form of a feed gas comprising the steps of cooling the gas and partially liquefying the gas by expansion within an expansion device, wherein the pressure of the gas at the inlet of the expansion device is in the range from 40 bar to 100 bar and the pressure of the gas at the outlet of the expansion device is in the range from 4 bar to 10 bar.

2. A method according to claim 1, wherein the pressure of the gas at the outlet of the expansion device is in the range from 4 bar to 6 bar.

3. A method according to claim 2, wherein the pressure of the gas at the outlet of the expansion device is substantially 5 bar.

4. A method according to claim 1, wherein the pressure of the gas at the inlet of the expansion device is in the range from 40 bar up to a pressure below the critical pressure of the gas.

5. A method according to claim 4, wherein the pressure of the gas at the inlet of the expansion device is in the range from 45 bar up to a pressure below the critical pressure of the gas.

6. A method according to claim 1, comprising cooling the methane-rich gas in at least one heat exchange device.

7. A method according to claim 6, wherein the at least one heat exchange device utilizes additional refrigeration means.

8. A method according to claim 7, wherein the additional refrigeration means comprises a substantially closed circuit refrigeration system of cycling refrigerant material.

9. A method according to claim 8, comprising the additional steps of removing a by-product material and processing the by-product material to produce refrigerant material to fill and/or compensate for losses of material from the substantially closed circuit refrigeration system.

10. A method according to claim 9, comprising obtaining the by-product material by separating material from a flash gas.

11. A method according to claim 9, comprising obtaining the by-product material by processing the feed gas.

12. A method according to claim 9, wherein the by-product material comprises compounds selected from the group consisting of propane, butane, and heavier hydrocarbon compounds.

13. A method according to claim 9, comprising flashing the by-product material within a flash vessel to produce a refrigerant vapor.

14. A method according to claim 13, wherein the by-product material entering the flash vessel has a pressure in a range from 20 bar to 1 bar.

15. A method according to claim 14, wherein the by-product material entering the flash vessel has a pressure in a range from 10 bar to 5 bar.

16. A method according to claim 13, wherein the by-product material entering the flash vessel is at a temperature in a range from −20 degrees Celsius to 60 degrees Celsius.

17. A method according to claim 16, wherein the by-product material entering the flash vessel is at a-temperature in a range from 20 degrees Celsius to 40 degrees Celsius.

18. A method according to claim 13, comprising incorporating the vapor into the refrigerant material of the substantially closed circuit refrigeration system.

19. A method according to claim 1, comprising cooling the methane-rich gas to a temperature in a range from −50 degrees Celsius to 5 degrees Celsius below its dew point, prior to entry the expansion device.

20. A method according to claim 19, comprising cooling the methane-rich gas to a temperature substantially equivalent to its dew point, prior to entry into the expansion device.

21. A method according to claim 1, wherein the methane-rich gas is outside a phase equivalent to its dense phase prior to entry into the expansion device.

* * * * *